United States Patent [19]

Sugawara

[11] Patent Number: 4,824,023

[45] Date of Patent: Apr. 25, 1989

[54] FLOW DEFLECTING DEVICE

[75] Inventor: Norio Sugawara, Nara, Japan

[73] Assignee: Matsushita Electric Industrial Co., Ltd., Osaka, Japan

[21] Appl. No.: 68,337

[22] Filed: Jul. 1, 1987

[30] Foreign Application Priority Data

Jul. 2, 1986 [JP] Japan ..... 61-155397
Jul. 2, 1986 [JP] Japan ..... 61-155398

[51] Int. Cl.[4] ..... B05B 1/26

[52] U.S. Cl. ..... 239/509; 98/40.24; 239/512; 239/514

[58] Field of Search ..... 239/505, 506, 509, 512, 239/513, 514, 515, 454; 98/2, 40.18, 40.24

[56] References Cited

U.S. PATENT DOCUMENTS

| | | | |
|---|---|---|---|
| 648,255 | 4/1900 | Haines | 239/506 |
| 2,077,725 | 4/1937 | Tyler | 239/515 |
| 2,337,298 | 12/1943 | Nedbor | 239/506 |
| 2,489,952 | 11/1949 | Boudreaux et al. | 239/515 |
| 2,676,062 | 4/1954 | Hamilton | 239/509 |
| 3,224,683 | 12/1965 | Morreale | 239/515 |
| 3,231,353 | 1/1966 | Julio | 239/512 |
| 3,802,328 | 4/1974 | Kakizaki | 98/2 |
| 4,135,440 | 1/1979 | Schmidt et al. | 98/40.02 |
| 4,556,172 | 12/1985 | Sugawara et al. | 239/590.5 |
| 4,570,533 | 2/1986 | Sugawara et al. | 239/513 |
| 4,585,177 | 4/1986 | Sugawara et al. | 239/590 |
| 4,607,565 | 8/1986 | Sugawara et al. | 98/40.24 |
| 4,677,904 | 7/1987 | Natsumeda et al. | 98/40.24 |
| 4,699,322 | 10/1987 | Jobst | 98/40.24 |

FOREIGN PATENT DOCUMENTS

| | | | |
|---|---|---|---|
| 0132847 | 2/1985 | European Pat. Off. . | |
| 669746 | 1/1939 | Fed. Rep. of Germany . | |
| 1604129 | 9/1970 | Fed. Rep. of Germany . | |
| 2256126 | 8/1973 | Fed. Rep. of Germany . | |
| 2314444 | 1/1977 | France . | |
| 1310493 | 3/1973 | United Kingdom | 98/40.18 |
| 2095523 | 10/1982 | United Kingdom | 239/513 |

OTHER PUBLICATIONS

European Search Report, for Application No. EP 87109440.5, dated 29-04-1988.

*Primary Examiner*—Andres Kashnikow
*Assistant Examiner*—Michael J. Forman
*Attorney, Agent, or Firm*—Wenderoth, Lind & Ponack

[57] ABSTRACT

A flow deflecting device to be provided in an air outlet of an air conditioning equipment or the like to deflect the flow supplied from a supply source towards any desired direction. The flow deflecting device is internally provided with a flow path for permitting the flow to pass through it, a nozzle disposed at the downstream end of the flow path to issue the flow from it, a control member disposed in the flow path so as to be rotatable and movable in the direction of the flow, and a deflecting member disposed at the downstream side of the nozzle. The angle of inclination of the deflecting member with respect to the control member can be controlled in compliance with the movement of the control member in the direction of the flow in the flow path.

16 Claims, 7 Drawing Sheets

FLOW DEFLECTING DEVICE

BACKGROUND OF THE INVENTION

The present invention generally relates to a device for deflecting a stream or flow such as a fluid flow or the like and more particularly, to a flow deflecting device to be provided in an air outlet of an air conditioning equipment or the like to deflect and send the flow supplied from a supply source towards any desired direction.

One of the conventional flow deflecting devices is illustrated in FIG. 1, which deflects the flow issued from a nozzle 1 by means of a deflecting plate 2 so that the flow may flow on and along a guide wall 3. A negative pressure zone 4 is defined between the nozzle 1 and guide wall 3 to promote the deflection of the flow.

In the above described flow deflecting device, although it is made possible to deflect the flow in the circumferential direction of the nozzle 1 by rotating the deflecting plate 2 through a knob 5, this kind of device has a drawback in that the flow can not be issued straight forwards i.e., upwards in FIG. 1.

SUMMARY OF THE INVENTION

Accordingly, the present invention has been developed with a view to substantially eliminating the above described disadvantage inherent in the prior art flow deflecting device, and has for its essential object to provide an improved flow deflecting device which not only blows out a flow forwards substantially straight from a nozzle disposed therein, but also can deflect the flow greatly in any desired direction or in every direction by controlling the flow so as to run along a guide wall.

Another important object of the present invention is to provide a flow deflecting device of the above described type which is simple in construction and stable in functioning, and can be readily manufactured at low cost.

In accomplishing these and other objects, according to one preferred embodiment of the present invention, there is provided a flow deflecting device defining therein a flow path for permitting the flow to pass therethrough, which includes a nozzle disposed at the downstream end of the flow path to issue the flow therefrom, a control member disposed in the flow path so as to be rotatable and movable in the direction of the flow, and a deflecting member disposed at the downstream side of the nozzle, whereby the angle of inclination of the deflecting member with respect to the control member can be controlled in compliance with the movement of the control member in the direction of the flow in the flow path.

BRIEF DESCRIPTION OF THE DRAWINGS

Objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENT

Figure 1:
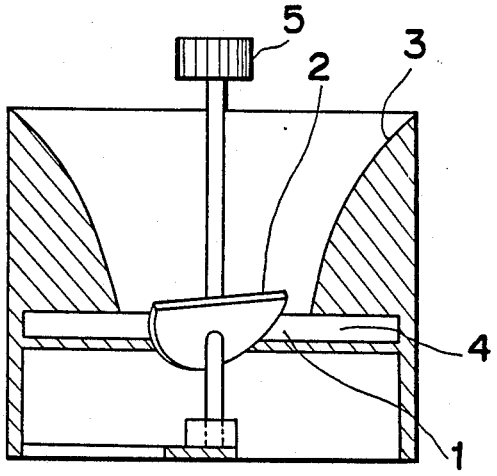
Fig. 1 PRIOR ART
FIG. 1 is a cross-sectional view of a conventional flow deflecting device (already referred to)
Figure 2:
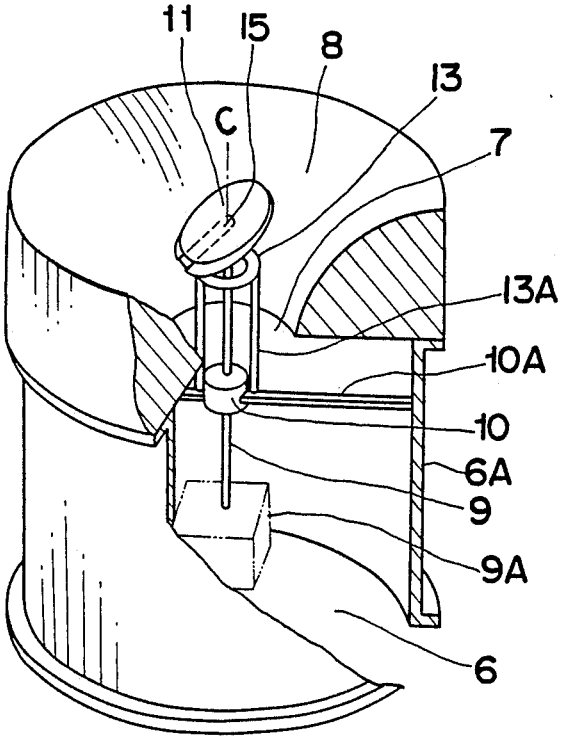
FIG. 2. is a partially cutaway perspective view of the flow deflecting device according to a first embodiment of the present invention.
Figure 3:
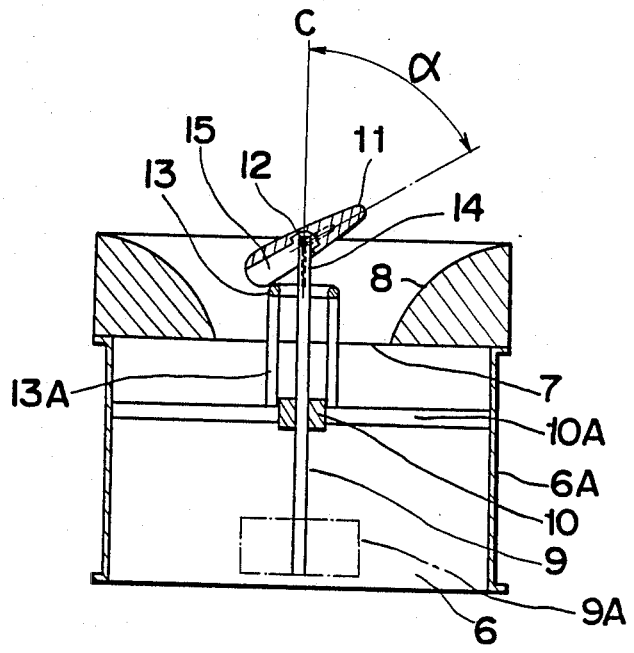
FIG. 3 is a cross-sectional view of FIG. 2.
Figure 4:
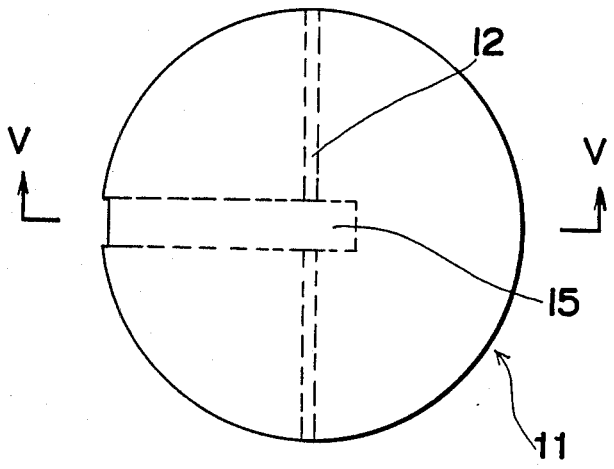
FIG. 4 is a top plan view, on an enlarged scale, of a main portion of FIG. 2.
Figure 5:
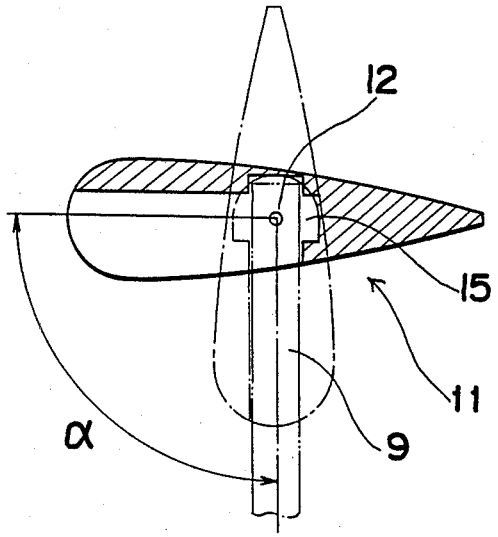
FIG. 5 is a section taken along the line V—V in FIG. 4.

Referring first to FIGS. 2 to 4, a flow deflecting device according to a first embodiment of the present invention is generally provided with a flow path 6 for permitting the flow to pass therethrough, a nozzle 7 defined at the downstream end of the flow path 6 to issue the flow therefrom, and a guide wall 8 encircling the nozzle 7 and gradually enlarged towards the downstream side of the flow. Although the nozzle 7 is formed into a circle in FIG. 2, it may be formed into a rectangle or a polygon. Furthermore, although the guide wall 8 has a circular cross section in the direction perpendicular to the central axis C of the flow path 6, the section may be formed into a polygonal shape. The guide wall 8 is not necessarily required in the flow deflecting device, since it effects only to improve the flow characteristics. A control shaft 9 is disposed in the flow path 6, not only rotatably but reciprocably in the axial direction thereof i.e., in the direction of the flow by means of a driving mechanism 9A which is generally composed of a motor, a cam or the like. There exists a motor capable of simultaneously effecting the rotation and the reciprocation, and such motor can be employed as the driving means. The control shaft 9 is supported and guided by a bearing 10 which is rigidly secured to a wall 6A of the flow path 6 by way of a plurality of bearing support bars 10A. At the downstream side of the nozzle 7 is disposed a deflecting member 11 of a disc having a wing-like cross section, which is capable of rotating around a rotational shaft 12 disposed at the downstream side of the control shaft 9. The cross section of the deflecting member 11 may be formed into an oblong, since it is illustrated in the form of a wing in FIG. 3 only on account of improvement in the flow characteristics. An angle setting member 13 having a substantially circular cross section is securely connected to the bearing support bars 10A through a plurality of rods 13A and disposed in the vicinity of the nozzle 7 so that an angle $\alpha$ of inclination of the deflecting member 11 may be changed upon contact with the angle setting member 13 in compliance with the movement of the control shaft 9 in the direction of the flow. The angle setting member 13 is formed annularly so as to facilitate the rotation of the deflecting member 11 around the central axis C of the flow path 6. A spring 14 is disposed at the downstream end of the control shaft 9 to bias the deflecting member 11 in the direction required to decrease the angle $\alpha$ of inclination thereof. A groove 15 is defined in the deflecting member 11 so that the deflecting member 11 may be rotatable approximately within an angle of 90° in the range of the angle $\alpha$ of inclination, as shown in FIG. 5, with the width of the groove 15 being substantially identical to that of the control shaft 9.

Figure 6:
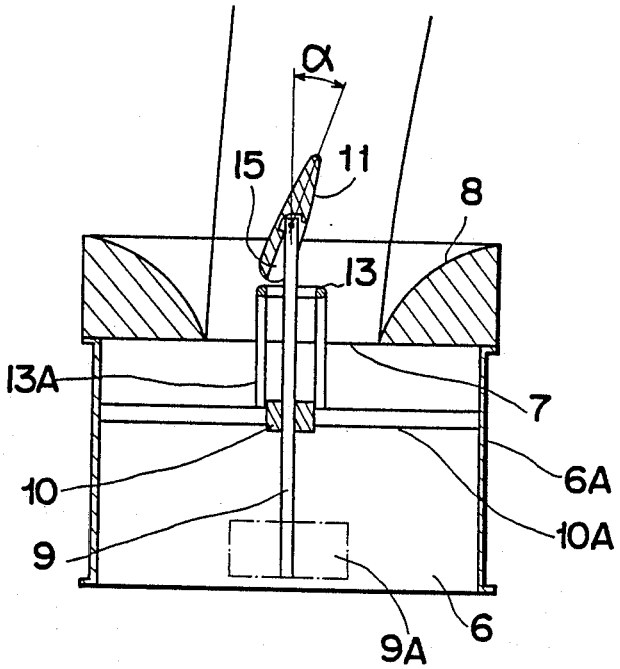
FIGS. 6, 7 and 8 are views each similar to FIG. 3, showing various different conditions of the main portion of FIG. 4.
Figure 7:
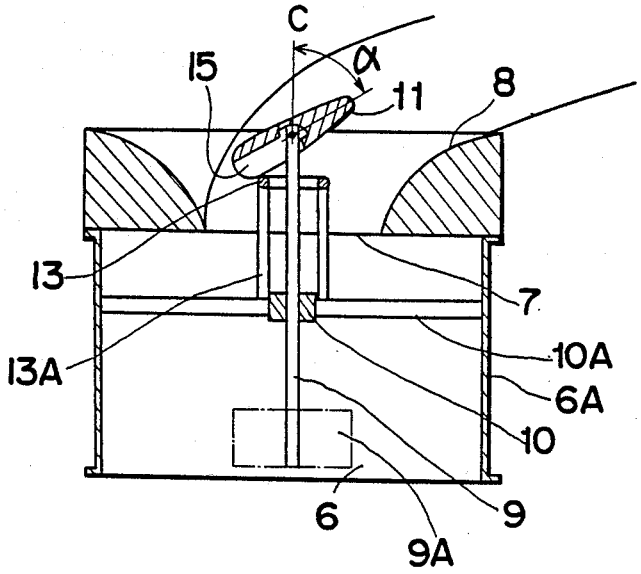
Figure 8:
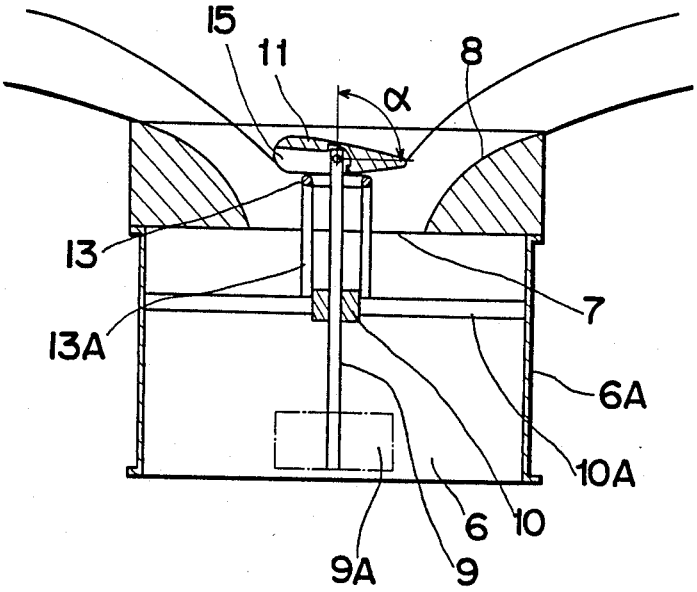

With reference to FIGS. 6 to 8, the operation of the flow deflecting device having the above described construction will be explained hereinbelow.

In the case where the angle $\alpha$ of inclination of the deflecting member 11 is small as shown in FIG. 6, that is to say, in the case where the control shaft 9 has been shifted downstream, the flow sent from the nozzle 7 is directed substantially forwards without any interference with the guide wall 8. In this case, since the control shaft 9 is located downstream, the deflecting member 11 is caused to inevitably move downstream and the flow, therefore, is not so much disturbed thereby. In the case where the flow is required to be directed forwards, it had better not be subject to the influence of deflecting member 11.

As shown in FIG. 7, in the case where the deflecting member 11 is inclined to some extent upon contact with the angle setting member 13 by moving the control shaft 9 upstream, the flow from the nozzle 7 is directed towards the guide wall 8. Consequently, the flow and guide wall 8 interfere with each other and the flow is, therefore, deflected greatly towards right side in FIG. 7. It is to be noted that the deflection of the flow will also take place even without the guide wall 8 and the flow can be deflected towards left side in FIG. 7 by rotating the control shaft 9 around the central axis C of the flow path 6.

As shown in FIG. 8, when the angle $\alpha$ of inclination of the deflecting member 11 is caused to be substantially 90° by further shifting the control shaft 9 upstream, the flow issued from the nozzle 7 flows out in the entire circumferential direction uniformly along the whole surface of the guide wall 8. Even in the case where no guide wall 8 is provided, the flow will come out of the nozzle 7 similarly.

As described so far, upon rotation of the control shaft 9 or reciprocation thereof in the direction of the flow, it makes possible to direct the flow issued out of the nozzle 7 substantially forwards or to deflect it in any desired direction or simultaneously in the entire circumferential direction. Moreover, since the deflecting member 11 has a cross section in the form of a wing, it causes little disturbance of the flow and the deflection thereof is effected desirably.

Figure 9:
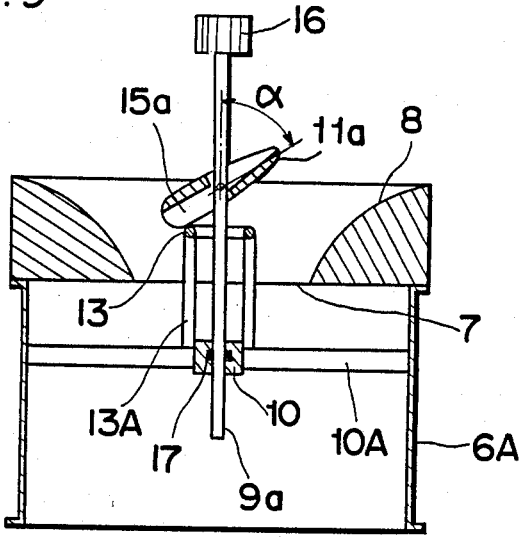
FIG. 9 is a view similar to FIG. 3, which particularly shows a modification thereof.

FIG. 9 illustrates a modification of the flow deflecting device as referred to above. In this modification, a knob 16 securely connected to the control shaft 9*a* is disposed at the downstream side of the nozzle 7 so that the control shaft 9*a* may be operated manually by the knob 16. In this case, it is necessary to provide a friction portion 17 including an O-ring for securing the control shaft 9*a*.

Figure 10:
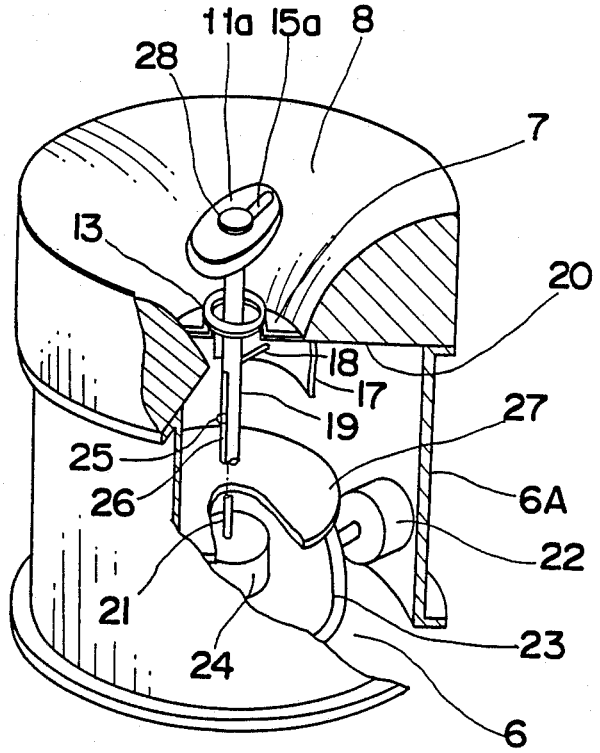
FIG. 10 is a partially cutaway perspective view of the flow deflecting device according to a second embodiment of the present invention.
Figure 11:
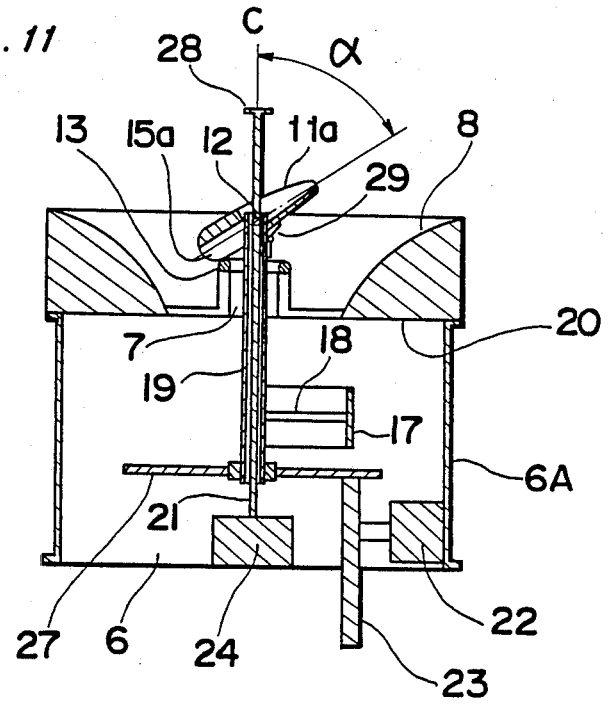
FIG. 11 is a cross-sectional view of FIG. 10.

FIGS. 10 or 11 shows the flow deflecting device according to a second embodiment of the present invention, which is internally provided with an outer control shaft 19, an inner control shaft 21, a throttle 20 formed on the nozzle 7 to produce a biased flow directed towards the control shafts 19 and 21 and a biased flow interception member 17 for intercepting a part of the biased flow. The biased flow interception member 17 has a cross section substantially in the form of a circular arc and is rigidly connected substantially at its central position to the outer control shaft 19 by way of a support rod 18. The disc-like deflecting member 11*a* is disposed in the vicinity of the guide wall 8 at the downstream side of the nozzle 7 and mounted rotatably around the rotational shaft 12 at the downstream end of the outer control shaft 19. The rotational shaft 12 is set substantially at right angles with respect to the support rod 18 of the biased flow interception member 17 so that the deflecting member 11*a* may be rotatable in a plane formed by the support rod 18 and outer control shaft 19, with a groove 15*a* being defined in the deflecting member 11*a* to permit the rotational movement thereof in the angular range of approximately 90°. The outer control shaft 19 is disposed reciprocably along the inner control shaft 21 in the direction of the flow and the amount of its reciprocation is controlled by a cam 23 which is rotatably driven by a first motor 22 rigidly secured on the inner surface of the wall 6A. In the meantime, the inner control shaft 21 is disposed inside the outer control shaft 19 so as to be rotatably driven by a second motor 24 rigidly secured to the wall 6A and its rotational movement is transmitted to the outer control shaft 19, since a projection 25 formed on the inner control shaft 21 is inserted in a groove 26 defined in the outer control shaft 19. Accordingly, both of the inner and outer control shafts 21 and 19 are capable of rotating simultaneously. A disc 27 is fixedly mounted on the outer control shaft 19 to transmit a displacement of the cam 23 to the outer control shaft 19. A stopper 28 is fixedly mounted on the inner control shaft 21 at the downstream end thereof to restrict the movement of the deflecting member 11*a* towards the downstream side. The angle setting member 13 is interposed between the biased flow interception member 17 and deflecting member 11*a* and securely coupled to the throttle 20. A return spring 29 is disposed between the deflecting member 11*a* and outer control shaft 19 to bias the deflecting member 11*a* in a direction required for decreasing the angle $\alpha$ of inclination thereof.

Figure 12:
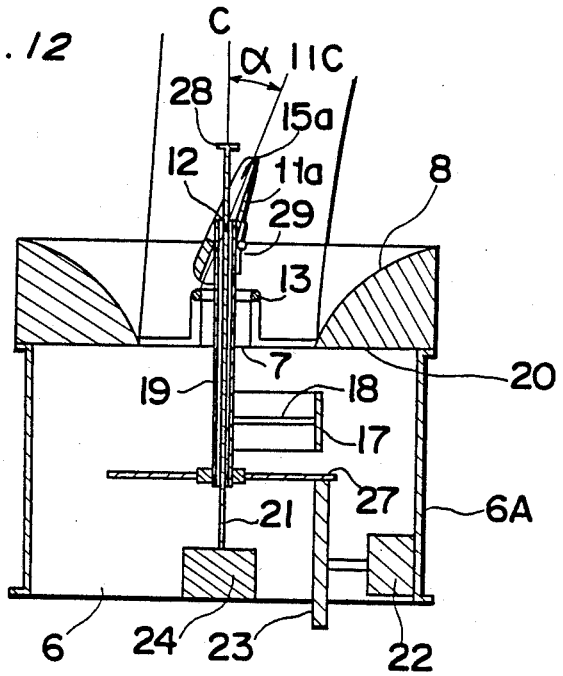
FIGS. 12, 13 and 14 are views each similar to FIG. 11, showing various different conditions of the main portion of FIG. 10.
Figure 13:
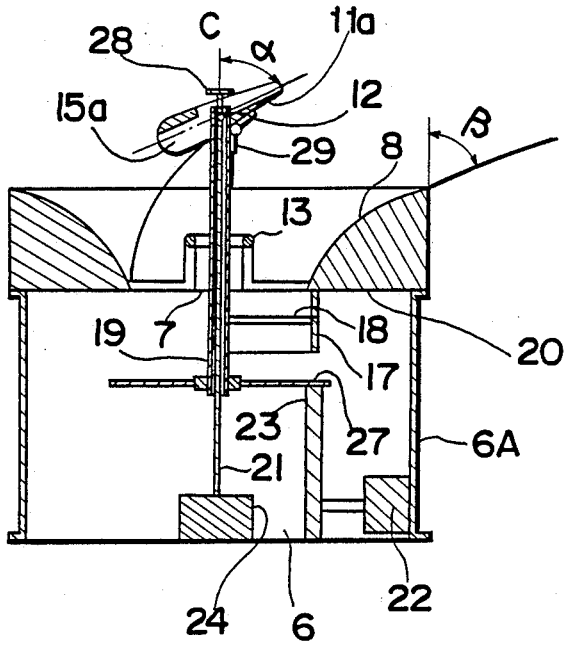
Figure 14:
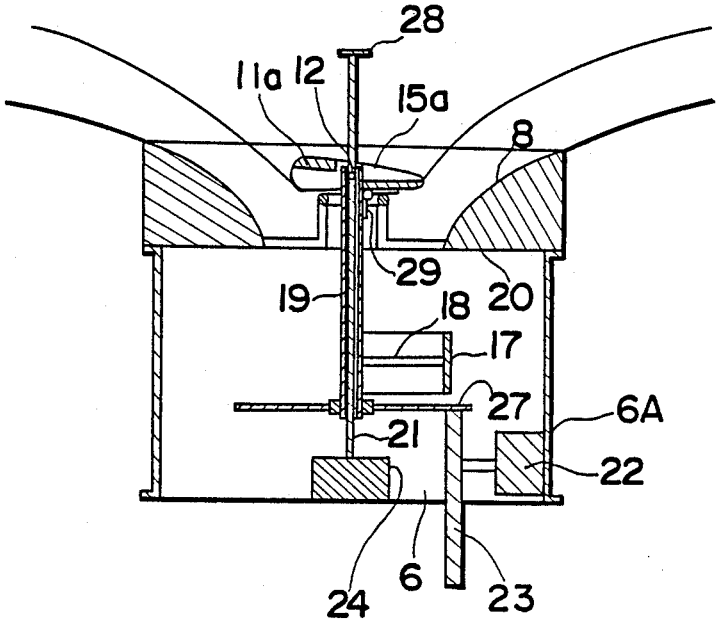

With reference to FIGS. 12 to 14, the operation of the flow deflecting device having the above described construction will be explained hereinafter.

In the case where the biased flow interception member 17 has been transferred upstream, the flow issued out of the nozzle 7 is directed upwards in FIG. 12 without any deflection thereof. In this event, the deflecting member 11*a* is nearly in a parallel relationship with the central axis C of the flow path 6 under the influence of a biasing force of the return spring 29. In other words, the angle $\alpha$ formed between the center line 11C of the deflecting member 11*a* and the central axis C of the flow path 6 is close to zero. Accordingly, the flow sent from the nozzle 7 is directed substantially straight forwards i.e., upwards in FIG. 12 without any influence by the deflecting member 11*a*.

When the biased flow interception member 17 has been brought into close contact with the nozzle 7, as shown in FIG. 13, the biased flow on the side of the interception member 17 i.e., on the right side in FIG. 13 is intercepted thereby. Consequently, the biased flow on the left side is directed towards and deflected along the guide wall 8 on the right side. In this case, since the deflecting member 11*a* is shifted downstream together with the biased flow interception member 17 through the outer control shaft 19 and brought into contact with the stopper 28, the deflecting member 11*a* rotates around the rotational shaft 12. The stopper 28 is set at the downstream end of the inner control shaft 21 so that the angle $\alpha$ of inclination of the deflecting member 11*a* may be substantially identical to a tangential angle $\beta$ of the guide wall 8 at the downstream end thereof with respect to the central axis C of the flow path 6. Under such circumstances, since the deflecting member 11*a* is directed in the direction required for deflecting the flow, the flow issued from the nozzle 7 and directed towards the right side in FIG. 13 is promoted to flow more closely along the guide wall 8, thus resulting in that the deflection characteristics can be improved. When the reciprocable members such as the outer control shaft 19, biased flow interception member 17 and the like are located at their respective positions between those as shown in FIGS. 12 and 13, the angle of inclination of the deflecting member 11*a* and the extent to which the flow is deflected are set to respective intermediate ones and the latter varies in proportion to the former. The reciprocation of the outer control shaft 19 is effected by the cam 23 which is rotatably driven by the first motor 22, since the disc 27 rigidly secured to the outer control shaft 19 is kept in contact with the cam 23 at every moment. More specifically, the position of the outer control shaft 19, that is, the position of the biased flow interception member 17 or the angle of inclination of the deflecting member 11*a* can be controlled by controlling the rotational movement of the first motor 22. Both of the biased flow interception member 17 and deflecting member 11*a* always rotate simultaneously, since the projection 25 formed on the inner control shaft 21 is inserted into the groove 26 defined in the outer control shaft 19, as described previously. Accordingly, the direction towards which the flow is biased is freely changeable.

With reference to FIG. 14, the case where the biased flow interception member 17 has been shifted most upstream will be described hereinbelow.

In this case, the deflecting member 11*a* is brought into contact with the entire uppermost surface of the angle setting member 13 and the angle of inclination thereof becomes approximately 90°. Under such conditions, although the flow issued from the nozzle 7 is directed forwards, it flows completely along the entire surface of the guide wall 8 in every direction under the influence of the biasing effect by the deflecting member 11*a*. As a result, the flow is issued sideways uniformly in every direction, that is to say, the flow is brought into a uniformly dispersed state. As described so far, by the construction such that the deflecting member 11*a* is caused to rotate in association with the movement of the biased flow interception member 17, it is capable of biasing the flow in any desired direction or of dispersing it in every direction not only by the biased flow interception member 17 but also by the deflecting member 11*a*.

Accordingly, in the case where the flow deflecting device of the present invention is provided in an air outlet defined in an air conditioning equipment such as an air conditioner or the like, the flow issued therefrom is directed in any desired direction in accordance with the conditions within a room air-conditioned, thus resulting in that a comfortable air-conditioning can be achieved.

It should be noted that although the aforementioned operation has been described with respect to a gas, for example, the air, a liquid or a pulverized material can be controlled in the same way as described so far with the use of the flow deflecting device of the present invention.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A flow deflecting device comprising:

a housing having a flow path having upstream and downstream ends therein;

a nozzle means in said housing at the downstream end of said flow path for issuing a flow therefrom;

a flow deflecting means at the downstream end of said nozzle for deflecting the flow issuing from said nozzle; and control means attached to said housing and attached to said flow deflecting means for controlling the angle of inclination of said flow deflecting means with respect to said flow path and for controlling the angle of rotation of said flow deflecting means with respect to the direction of said flow path for controlling the angle of rotation and the angle of inclination of the flow issuing from said nozzle with respect to said flow path.

2. A device as in claim 1, wherein said control means includes a reciprocable and rotatable control member reciprocably and rotatably attached to said housing for moving in the direction of said flow path and for rotating relative to said flow path, said control member further includes an angle setting member attached to said housing, and said control member reciprocating in the direction of said flow path for moving said flow deflecting means relative to said angle setting member, and said angle setting member being contacted by said flow deflecting means during at least part of the movement of said control member for controlling the angle of inclination of said flow deflecting means relative to the direction of said flow path.

3. A device as in claim 2, wherein said control member is attached to said flow deflecting means downstream from said angle setting member, and when said control member moves downstream in the direction of said flow path said flow deflecting means moves relative to said angle setting member for decreasing the angle of inclination of said flow deflecting means relative to the direction of said flow path.

4. A device as in claim 3, wherein said angle setting member is substantially annular, and said control member extends therethrough.

5. A device as in claim 3, wherein said flow deflecting means is a deflecting member, said deflecting member has a groove for receiving at least part of said control member therein, and the at least part of said control member is received in said groove when said control member moves sufficiently downstream to decrease the angle of inclination of said deflecting member relative to the direction of said flow path substantially to zero.

6. A flow deflecting device comprising:

a housing having a flow path having upstream and downstream ends therein;

a nozzle means in said housing at the downstream end of said flow path for issuing a flow therefrom;

a guide wall in said nozzle for guiding the flow, said guide wall being gradually enlarged in the downstream direction of the flow;

a flow deflecting means at the downstream end of said nozzle for deflecting the flow issuing from said nozzle; and control means attached to said housing and attached to said flow deflecting means for controlling the angle of inclination of said flow deflecting means with respect to said flow path and for controlling the angle of rotation of said flow deflecting means with respect to the direction of said flow path for controlling the angle of rotation and the angle of inclination of the flow issuing from said nozzle with respect to said flow path.

7. A device as in claim 6, wherein said control means includes a reciprocable and rotatable control member reciprocably and rotatably attached to said housing for moving in the direction of said flow path and for rotating relative to said flow path, said control member further includes an angle setting member attached to said housing, and said control member reciprocating in the direction of said flow path for moving said flow deflecting means relative to said angle setting member, and said angle setting member being contacted by said flow deflecting means during at least part of the movement of said control member for controlling the angle of inclination of said flow deflecting means relative to the direction of said flow path.

8. A device as in claim 7, wherein said control member is attached to said flow deflecting means downstream from said angle setting member, and when said control member moves downstream in the direction of said flow path said flow deflecting means moves relative to said angle setting member for decreasing the angle of inclination of said flow deflecting means relative to the direction of said flow path.

9. A device as in claim 8, wherein said angle setting member is substantially annular, and said control member extends therethrough.

10. A device as in claim 8, wherein said flow deflecting means is a deflecting member, said deflecting member has a groove for receiving at least part of said control member therein, and the at least part of said control member is received in said groove when said control member moves sufficiently downstream to decrease the angle of inclination of said deflecting member relative to the direction of said flow path substantially to zero.

11. A flow deflecting device comprising:

a housing having a flow path having upstream and downstream ends therein;

a nozzle means in said housing at the downstream end of said flow path for issuing a flow therefrom;

a guide wall in said nozzle for guiding the flow, said guide wall being gradually enlarged in the downstream direction of the flow;

a throttle in said nozzle for directing the flow inwardly towards the center of said nozzle;

a flow deflecting means at the downstream end of said nozzle for deflecting the flow issuing from said nozzle;

control means attached to said housing and attached to said flow deflecting means for controlling the angle of inclination of said flow deflecting means with respect to said flow path and for controlling the angle of rotation of said flow deflecting means with respect to the direction of said flow path for controlling the angle of rotation and the angle of inclination of the flow issuing from said nozzle with respect to said flow path; and a biased flow interception member fixedly attached to said control means for movement therewith, said biased flow interception member being located upstream in the direction of flow from said nozzle, and said biased flow interception member intercepting a part of the biased flow to be throttled and inwardly directed by said throttle.

12. A device as in claim 11, wherein said control means includes a reciprocable and rotatable control member reciprocably and rotatably attached to said housing for moving in the direction of said flow path and for rotating relative to said flow path, said control member further includes an angle setting member attached to said housing, and said control member reciprocating in the direction of said flow path for moving said flow deflecting means relative to said angle setting member, and said angle setting member being contacted by said flow deflecting means during at least part of the movement of said control member for controlling the angle of inclination of said flow deflecting means relative to the direction of said flow path.

13. A device as in claim 12, wherein said control member is attached to said flow deflecting means downstream from said angle setting member, and when said control member moves downstream in the direction of said flow path said flow deflecting means moves relative to said angle setting member for decreasing the angle of inclination of said flow deflecting means relative to the direction of said flow path.

14. A device as in claim 23, wherein said angle setting member is substantially annular, and said control member extends therethrough.

15. A device as in claim 13, wherein said flow deflecting means is a deflecting member, said deflecting member has a groove for receiving at least part of said control member therein, and the at least part of said control member is received in said groove when said control member moves sufficiently downstream to decrease the angle of inclination of said deflecting member relative to the direction of said flow path substantially to zero.

16. A device as in claim 11, wherein said biased flow interception member is substantially semiannular.

* * * * *